US005971436A

United States Patent [19]

Cox

[11] Patent Number: 5,971,436

[45] Date of Patent: Oct. 26, 1999

[54] INFORMATION DISPLAY DEVICE

[76] Inventor: Christine A. Cox, 79 E. Ravenwood, Youngstown, Ohio 44507

[21] Appl. No.: 08/907,349

[22] Filed: Aug. 6, 1997

[51] Int. Cl.[6] ..... B42D 15/00

[52] U.S. Cl. ..... 283/81; 283/79; 283/101; 283/100; 40/316

[58] Field of Search ..... 40/316, 317, 321, 40/322, 326, 334; 283/81, 79, 80, 100, 101

[56] References Cited

U.S. PATENT DOCUMENTS

| | | | |
|---|---|---|---|
| D. 192,845 | 5/1962 | Cohen . | |
| 836,905 | 11/1906 | Whitehouse . | |
| 1,463,755 | 7/1923 | West . | |
| 1,607,894 | 11/1926 | Johnson . | |
| 1,713,380 | 5/1929 | Green . | |
| 1,965,699 | 7/1934 | Goldstein . | |
| 2,204,307 | 6/1940 | Hearing . | |
| 3,068,600 | 12/1962 | Blanchet . | |
| 3,315,386 | 4/1967 | Kest et al. . | |
| 4,112,603 | 9/1978 | Giulie . | |
| 4,199,884 | 4/1980 | Loof | 40/316 |
| 4,268,986 | 5/1981 | Piana | 40/316 |
| 4,378,014 | 3/1983 | Elkow . | |
| 4,450,639 | 5/1984 | Duester | 40/322 |
| 4,526,404 | 7/1985 | Vazquez . | |
| 4,656,767 | 4/1987 | Tarrant | 40/316 |
| 4,795,426 | 1/1989 | Feldstein . | |
| 4,921,277 | 5/1990 | McDonough . | |
| 5,343,608 | 9/1994 | MacDonald . | |
| 5,468,022 | 11/1995 | Linder et al. . | |
| 5,560,657 | 10/1996 | Morgan | 283/81 |

*Primary Examiner*—Frances Han
*Attorney, Agent, or Firm*—Robert J. Herberger, Esq.

[57] ABSTRACT

The invention relates to an information display device which attaches to a tubular conduit. The tubular conduit has a longitudinal axis for transporting liquids. A display member having lateral and vertical edges and a display area for displaying information is attached to said tubular conduit by a tubular portion having a longitudinal vertical axis substantially parallel with the vertical edge of the display member. The attachment mechanism has an opening in the exterior wall along said longitudinal axis for inserting the tubular conduit therein. The display area is used for recording information. An extension member extends beyond the display area wrapping around the attachment tubular conduit for securing said information display device to said tubular conduit.

12 Claims, 2 Drawing Sheets

INFORMATION DISPLAY DEVICE

BACKGROUND OF THE INVENTION

The present invention relates in general to information display devices and, in particular to display devices to display information related to the medical treatment of patients with medications administered by intravenous means, commonly described as IV.

In this treatment, the liquid medication is contained in a pliable plastic bag which is typically hung in an elevated position and a supply tube carries the solution by gravitation or pump from the bag to the needle inserted in the patient's vein.

When such treatment is being administered, it is important that all of the care-givers who may be responsible for an IV administration are able to determine quickly and accurately the status of the treatment. Various stages of the treatment must be performed at specified intervals in order to prevent adverse reactions by the patient. For example, a typical IV procedure or Tubing Policy might include the following schedule items:

Change the parts of the system as follows:

a. IV solution—at least every 24 hours b. IV site rotation—every 72 hours c. Dressing—every 72 hours d. Primary Administration Sets—every 72 hours e. Secondary Administration Sets—every 24 hours A record of these changes must be available at the treatment site at all times for the benefit of all care-givers on all working shifts.

This information is, of course, always available in the patients medical chart. However, this chart is usually maintained at a central nurse's station and not in the patient's room. In the prior art, information regarding the treatment schedule has been entered on a label attached to the medication container which supplies the IV fluid. The label may then be transferred to the patient's chart. However, when the container is changed a new label must be attached and the last activity in the treatment regimen is available only in the chart.

This invention overcomes these disadvantages by providing a treatment information display device which can be attached directly to the IV tubing without the use of additional tools and without interfering with the flow of the medication and provides a labeling area with space for treatment information to be recorded. This device may be quickly replaced with a new device without disturbing the IV and, while in place, displays the latest activity in the treatment schedule. More than one display device may be placed on an IV tubular conduit at one time if additional information is required. In addition, the label may be provided with an elongated adhesive-backed portion which can be wrapped around the IV tubing to help secure the device in place.

DETAILED DESCRIPTION OF THE PREFERRED EMBODIMENT

Figure 1:
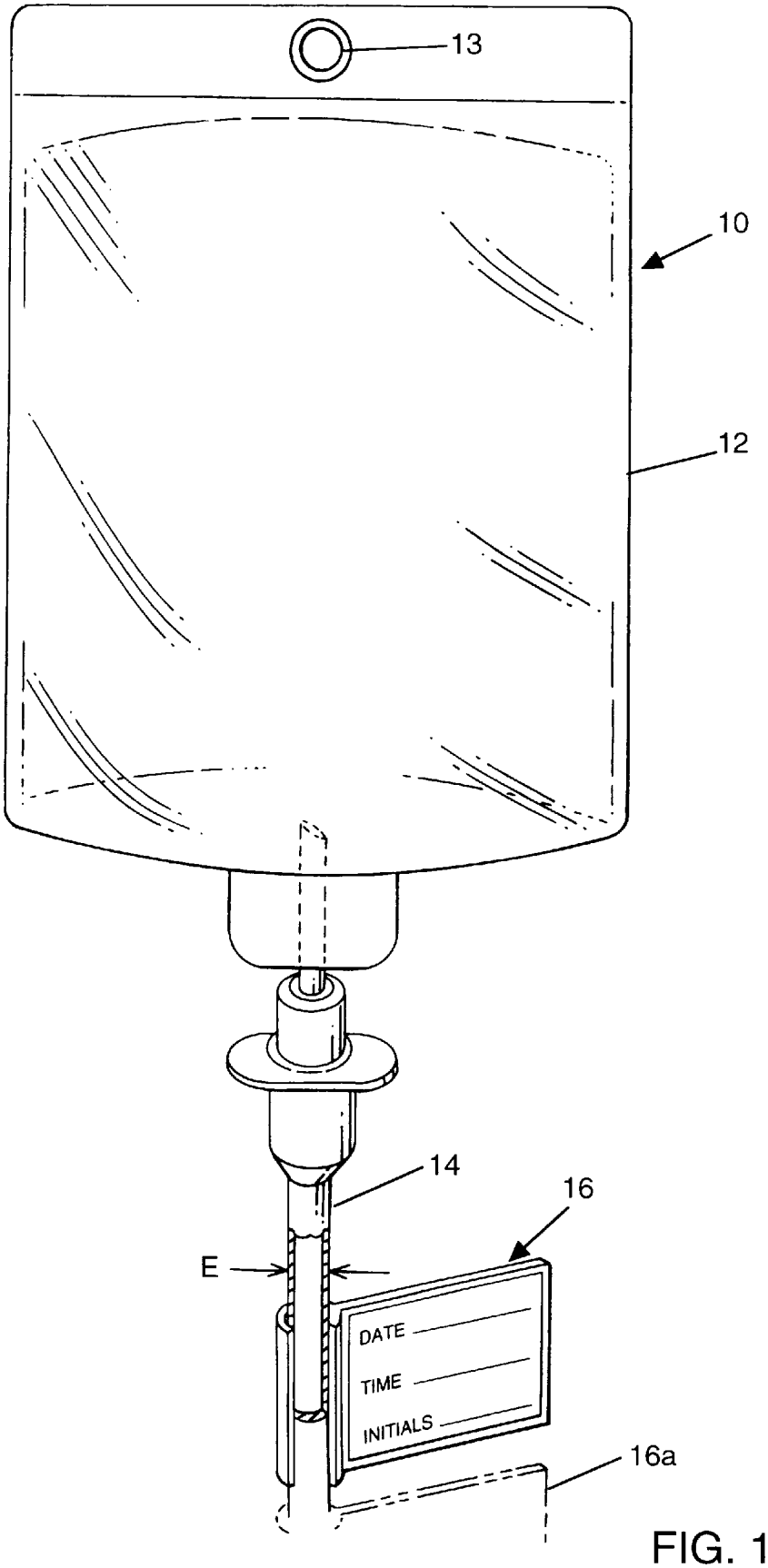
FIG. 1 is an isometric view of an IV apparatus assembly.

Referring now to FIG. 1, there is shown an IV assembly 10 which consists of a pliable plastic bag 12 which contains the liquid medication to be administered to a patient. The bag 12 is provided with a hole 13 in its upper edge for attaching the bag from a stand or other elevated location above the patient's IV site so that the medication will flow by force of gravity to the IV site. At the bottom of the bag there is provided a tubular conduit 14 for transporting the medication to the IV site. At the lower end of the conduit 14 a hollow IV needle (not shown) will be attached to the conduit and will be inserted in the vein of the patient. Between the bag 12 and the needle, the information display device 16 is attached to the conduit 14. Additional display devices, shown in phantom at 16*a,* may be attached to the conduit 14 if space is required for additional information.

Figure 2A:
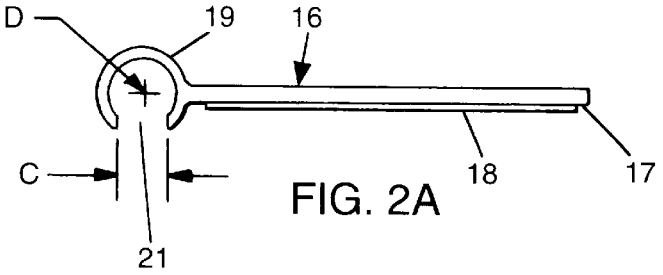
FIG. 2A is a plan view of the display device.
Figure 2B:
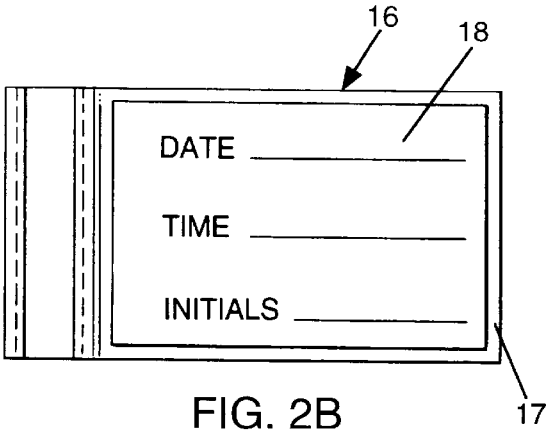
FIG. 2B is an elevation view of the device of FIG. 2A with a label attached.

Referring now to FIGS. 2A and 2B, the display device 16 is shown in more detail. The display device consists of a body portion 17 which has a planar area for receiving the label 18 on which the IV information is recorded. In order to attach the display device to the IV tubular conduit 14 without interfering with the flow of fluid in the conduit, the display device 16 is provided with a tubular portion 19 formed along one of the vertical sides of the display device 16. This tubular portion has an inside diameter "D" and an opening 21 having a dimension "C" provided along the front face of the tubular portion 19. The dimensions of the tubular portion "D" and the opening "C" will depend on the diameter "E" of the tubular conduit 14. As an example of the dimensions required for the attachment portion of the display device, a typical IV tube diameter of 0.12 to 0.14 inches will be assumed for dimension "E" of FIG. 1. For this diameter tubing, the inside diameter of the tubular portion 19 of the display device 16 should be nominally .14 inches and for the opening 21, dimension "C" will be nominally .13 inches. As a general rule, the opening 21 will be approximately 90 to 95 percent of the size of the tubular conduit 14. Thus it can be seen that the inside diameter of the tubular portion 19 will allow the tubing 14 to be placed inside the tubular portion 19 without constricting the tubing opening. The dimension "C" of the opening 21 allows the tubing 14 to be inserted in the tubular portion 19 by slightly compressing the tubing to allow it to be moved through the opening 21 and into the tubular portion 19 where it will re-expand to its original diameter "E".

Figure 3A:
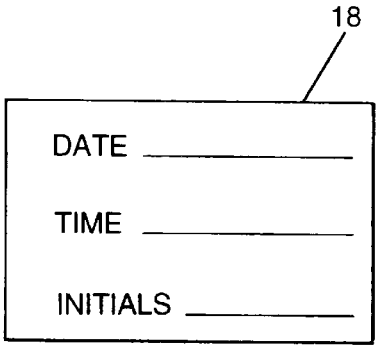
FIG. 3A is a detail of one embodiment of the information label.

In order to record the events of the IV treatment on the display device, an adhesive-backed label shown in FIG. 3A is provided for attachment to the face 17 of the display device 16. As illustrated, the label provides space for the date of the event, the time of the event and the initials of the care-giver who performed the required service. Of course, other headings may be provided on the label which are appropriate to the specific medication being provided to the patient.

Figure 3B:
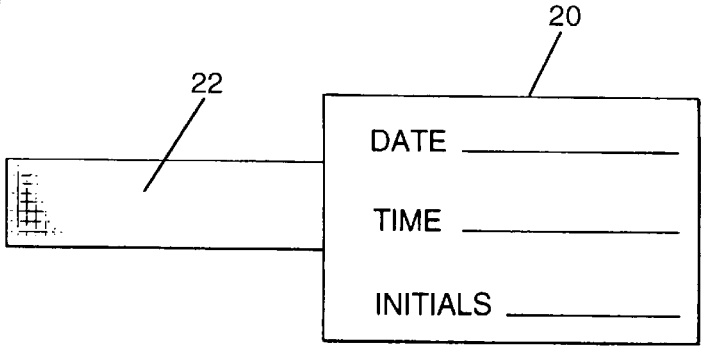
FIG. 3B is a detail of another embodiment of the label of FIG. 3A.
Figure 4:
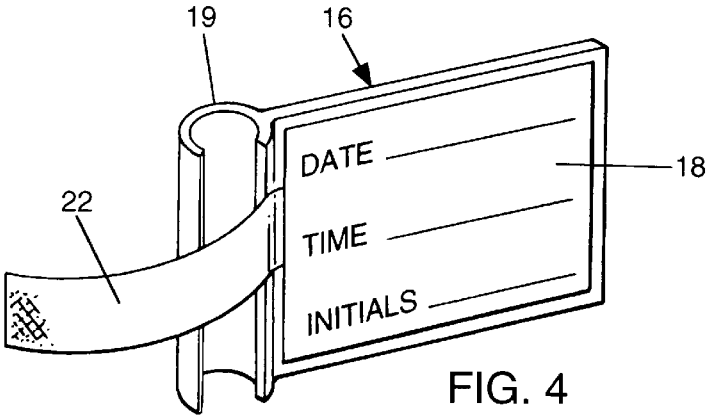
FIG. 4 is an isometric view of the label of FIG. 3B attached to the device of FIG. 2A.

Referring now to FIG. 3B, there is shown an alternate embodiment 20 of the label 18 shown in FIG. 3A. In this embodiment, an additional adhesive-backed extension 22 is provided on the main portion of the label 20. The extension 22 is used as a destructible-type tamper proof indicating tab or seal. As shown in FIG. 4, the extension 22 extends across the opening 21 of the tubular portion 19 and will be in contact with the outside wall of the conduit 14. In order to remove the display device 16 from the tubing 14, the extension 22 must be broke. This extension may also be used to secure the display device 16 to the tubing 14, thus preventing the device 16 from sliding down the conduit if the friction between the conduit outer wall and the inner surface of the tubular portion 19 of the device 16 is insufficient to hold the device in place. For example, if the diameter "E" of the conduit 14 is at the low side of the dimensional tolerance and the opening 19 of the display device 16 is at the high side of its dimensional tolerance the device may not stay in place by friction and must be restrained by the adhesive on the back of the extension 22 of the label 20.

Thus it can be seen that there is described above an information display and security device for attachment to an IV tubular conduit which allows necessary treatment information to be quickly recorded on a label on the device and maintained at the treatment site for reference by all of the care-givers connected with the treatment as well as being resistant to tamper. The device requires no special tool for installation and removal and, when attached to the IV tubular conduit, does not interfere with the free flow of medication at the specified rate.

What is claimed is:

1. An information display device for attaching to a tubular conduit comprising a compressible tubular conduit having a longitudinal axis for transporting liquids;

at least one display member having lateral and vertical edges and a substantially planar display area for displaying information;

display member attachment means for attaching said display member to said tubular conduit, said attachment means being affixed to one of the vertical edges of said display member and comprising a hard tubular portion having a longitudinal vertical axis substantially parallel with said vertical edge and having an opening through the exterior wall of said tubular member along said longitudinal axis for inserting said tubular conduit in the tubular portion of said display attachment member for attaching said display device to said tubular conduit, the width of the opening in the exterior wall the tubular member is equal to approximately 90 to 95 percent of the outside diameter of said tubular conduit; and label for recording information attached in the display area of said display member, said label includes an elongated extension member which extends beyond said display member and includes an adhesive on one side thereof for securing said information display device to said tubular conduit.

2. The information display device according to claim 1 in which a plurality of display devices are attached to the tubular conduit.

3. The information display device according to claim 1 wherein the inside diameter of the tubular member of said display attachment means is substantially equal to the outside diameter of the tubular conduit.

4. The information display device according to claim 1, wherein said label having a surface suitable for writing information upon and having means for attaching said label in the display area of said display member.

5. The information display device according to claim 4 wherein said means for attaching said label in the display area of said display member comprises an adhesive applied to one surface of said label adjacent said display member.

6. The information display device according to claim 4 in which a plurality of display devices are attached to the tubular conduit.

7. The information display device according to claim 5 in which a plurality of display devices are attached to the tubular conduit.

8. An information display device for use with intravenous tubing, said display device comprising:

a planar display element;

display attachment mechanism for attaching said display member to said tubing, said attachment mechanism being affixed to said display member and comprising a hard tubular portion having a longitudinal vertical axis substantially parallel with said vertical edge, the tubular member of said display attachment mechanism having an inside diameter not substantially less than the outside diameter of the intravenous tubing, and the tubular member having an opening through the exterior wall of said tubular member along said longitudinal axis for inserting said tubing in the tubular portion of said display attachment mechanism for attaching said display device to said tubing the width of the opening in the exterior wall of the tubular member of said attachment mechanism is equal to approximately 90 to 95 percent of the outside diameter of said tubing; and label for recording information, said label being attached in the display area of said display member, said label having an elongated extension member which extends beyond the display area of said display member and wraps around said tubing and said tubular portion of said attachment mechanism making a tamper-proof seal.

9. The information display device according to claim 8 wherein the inside diameter of the tubular member of said display attachment mechanism is substantially equal to the outside diameter of the tubing.

10. The information display device according to claim 9 wherein said label in the display area of said display member comprises an adhesive applied to one surface of said label adjacent said display member.

11. An information display device for use with intravenous tubing used for carrying liquid medication, said display device comprising:

a planer display element;

display attachment mechanism for attaching said display member to said tubing, said attachment mechanism being affixed to said display member and comprising a hard tubular portion having a longitudinal axis substantially parallel with said vertical edge, the tubular member of said display attachment mechanism having an inside diameter not substantially less than the outside diameter of the intravenous tubing, the tubular member further having an opening through the exterior wall of said tubular member along said longitudinal axis for inserting said tubing in the tubular portion of said display attachment mechanism for attaching said display device to said tubing, the width of the opening in the exterior wall of the tubular member of said attachment mechanism is equal to approximately 90 to 95 percent of the outside diameter of said tubing so that the flow of liquid medication through the intravenous tubing is not constricted when the information display device is being attached to the tubing; and label for recording information, said label being attached to the display area of said display member, said label having an extension member which extends beyond the display area of said display member and wraps around said tubing and said tubular portion of said attachment mechanism making a tamper-proof seal.

12. The information display device according to claim 11 wherein the inside diameter of the tubular member of said display attachment e mechanism is substantially equal to the outside diameter of the tubing.

* * * * *